US005085455A

United States Patent [19]

Bogner et al.

[11] Patent Number: 5,085,455

[45] Date of Patent: Feb. 4, 1992

[54] SPORTING BOARD WITH TWO BOOT BINDINGS

[75] Inventors: Martin Bogner, Ostfildern, Fed. Rep. of Germany; Henri Peyre, Saint Benin d'Azy, France

[73] Assignee: Look S.A., Nevers, France

[21] Appl. No.: 386,522

[22] Filed: Jul. 27, 1989

[30] Foreign Application Priority Data

Jul. 28, 1988 [DE] Fed. Rep. of Germany ..... 3825681

[51] Int. Cl.[5] ..... A63C 9/00

[52] U.S. Cl. ..... 280/618; 280/14.2

[58] Field of Search ..... 280/607, 616, 617, 618, 280/634, 637, 14.2

[56] References Cited

U.S. PATENT DOCUMENTS

| | | | |
|---|---|---|---|
| 4,652,007 | 3/1987 | Dennis | 280/618 |
| 4,741,550 | 5/1988 | Dennis | 280/618 |
| 4,844,502 | 7/1989 | Beshier | 280/607 |
| 4,869,524 | 9/1989 | Bouque | 280/617 |

FOREIGN PATENT DOCUMENTS

| | | | |
|---|---|---|---|
| 3622746 | 1/1988 | Fed. Rep. of Germany . | |
| 2600546 | 12/1987 | France | 280/607 |
| 2611516 | 9/1988 | France | 280/607 |
| 2615115 | 11/1988 | France | 280/607 |

OTHER PUBLICATIONS

WO89/03711, 5/1989, Pfaffenbichler.

*Primary Examiner*—Andres Kashnikow
*Assistant Examiner*—Michael Mar

[57] ABSTRACT

A snowboard has two boot bindings in the form of plate bindings (11, 11'), arranged at a considerable angle to the longitudinal direction of the board. The release mechanisms of the two plate bindings (11, 11') are coupled together in such a way that during release of the one plate binding (11, 11') the release force for the other respective plate binding (11', 11) is at least substantially reduced.

14 Claims, 7 Drawing Sheets

Figure 3:
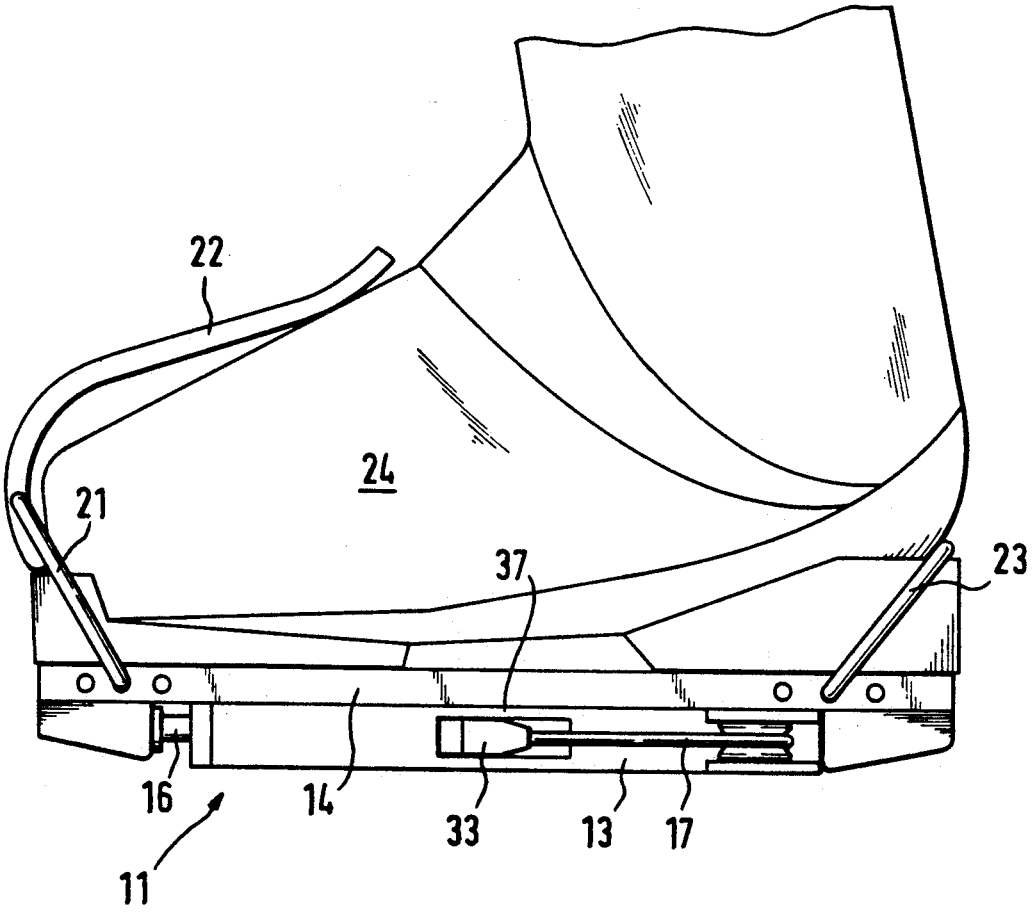

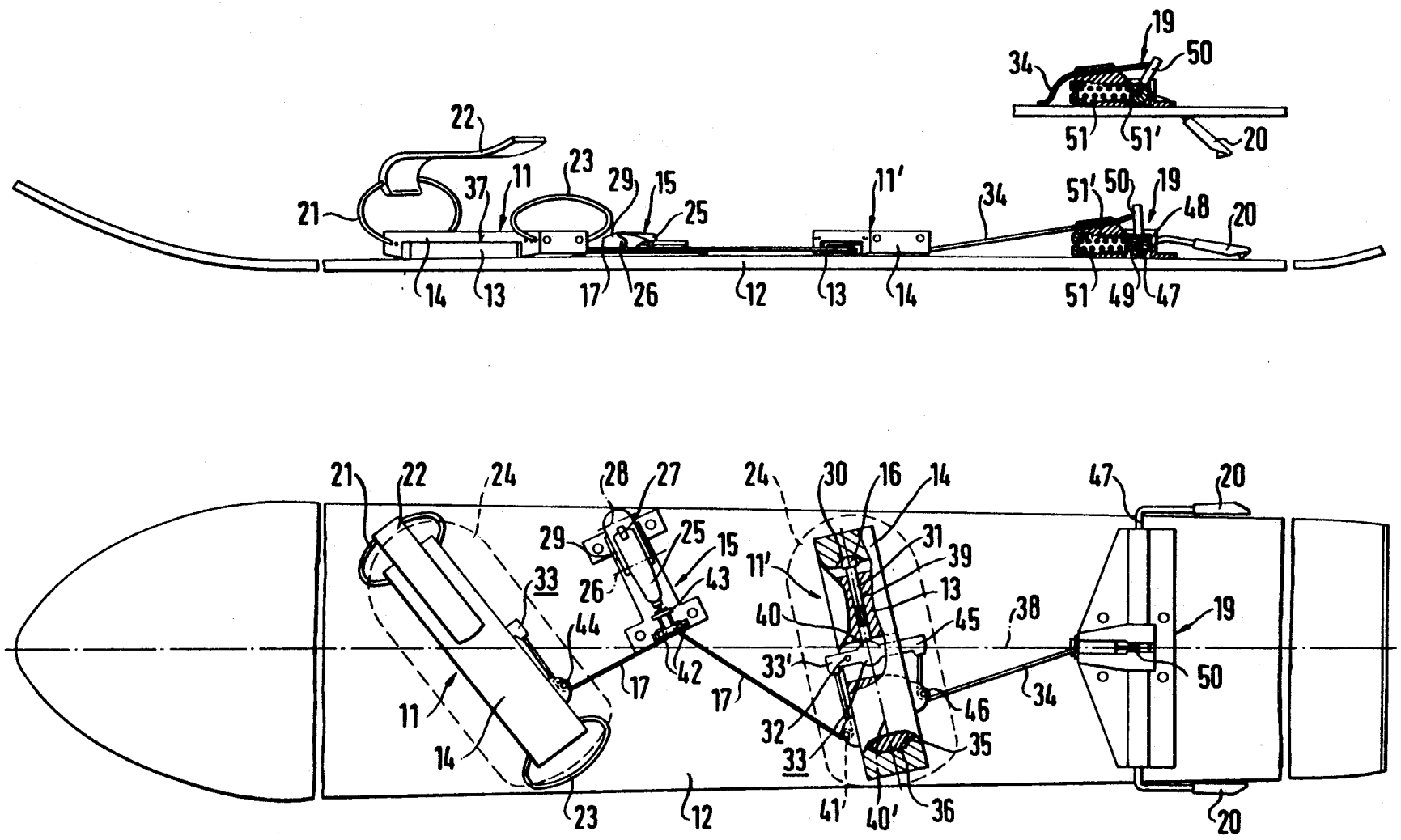
19
50
51'
51
34
20
48
47
49
11'
14
13
12
25
15
26
29
17
23
11
37
22
21
38
46
35
36
39
31
45
16
30
40'
41'
24
40
33'
32
33
42
43
27
28
44

SPORTING BOARD WITH TWO BOOT BINDINGS

The invention relates to a sporting board, in particular a snowboard having two boot bindings which are arranged at a considerable angle to the longitudinal direction of the board and which can be opened and closed by hand. The boot bindings can thereby either be arranged transversely or at an angle of for example 45° to the longitudinal direction of the board. The invention can however fundamentally also be used with so-called monoskis where the two boot bindings are arranged alongside one another on the board and extend in the longitudinal direction of the ski.

A snowboard is already known (German Gebrauchsmuster 88 01 972) in which the two boot bindings are releasable by a remote control. The continuous holding of the remote control by the board rider is however irksome and it must be feared that the board rider will either not timely effect the release by hand during a fall, or that he will drop the remote control so that he cannot even effect a release.

In a further known snowboard binding (U.S. Pat. Nos. 4,652,007, 4,741,550) the ski boots are arranged on a carrier plate arranged at a considerable angle to the longitudinal direction of the board and the carrier plate is in turn fixedly connected with a release plate which extends in the longitudinal direction of the board, and which is releasably held on the board by a normal ski safety binding consisting of toe and heel units. The heel unit of the front binding and the toe unit of the rear binding are arranged on a common plate which is displaceable in the longitudinal direction of the board. The arrangement is such that when the release plate becomes free from the board the relevant connection plate can also be displaced in such a way that the heel or toe unit of the other binding also frees the other release plate.

The disadvantage of this known sporting board is the fact that the release plates must extend in mutual alignment to one another in the longitudinal direction of the board, so that special carrying plates are necessary for the oblique boot mounting, and these must be connected with the release plate in a special and preferably adjustable manner. Furthermore, it is disadvantageous that a stiff and in particular non-creasable connection plate must be arranged between the two bindings which are arranged behind one another, and this connection plate must moreover be longitudinally displaceably mounted in problemfree manner, with it also being necessary to ensure that jamming cannot occur through contamination or ice and snow.

The object underlying the present invention is thus to provide a sporting board, in particular a snowboard which is provided with a safety release apparatus for both ski boots which takes special account of the conditions of riding on a sporting board, with the constructional complexity being kept low and in particular with a direct connection of the two ski bindings, for example by a displaceable stiff connection plate, being avoided.

In order to satisfy this object the present invention provides a sporting board of the initially named kind which is characterised in that each boot binding is formed as a plate binding comprising a base plate secured to the board and a release plate connectable to the boot, or formed by the sole of the boot itself, with the release plate being arranged above the base plate in alignment therewith and being releasable from the base plate both with predetermined torsional loads and also with predetermined tilting loads of the ski boot about its longitudinal axis; in that the release mechanism which releasably secures the release plate to the base plate is preferably located beneath or to the side of the release plate; and in that the release mechanisms of the two plate bindings are coupled together in such a way that on release of the one plate binding the release force of the other respective plate binding is at least substantially reduced.

The use of plate bindings which are known from the technology of ski bindings has the special advantage that the release mechanism can be provided under or alongside the release plate, so that no space is necessary either before or after the boot binding for the placement of a safety binding. Such space is hardly available because of the restricted width of the snowboard. It is of particular significance that the release mechanisms of the two plate bindings are coupled together in the sense defined in claim 1 so that on release of the one ski boot the other ski boot can also be released with a substantially lower release force, or indeed no release force. In this way the board rider comes completely free from the board, and is thus no longer exposed to a danger of injury brought about by the connection to the board. In this respect it is however important that one is concerned with customary plate bindings in which the base plate and the release plate are aligned with one another and do not in any event have to be put together with further plates arranged at an angle thereto. Furthermore, it is of significance that it is not the bindings themselves, but rather only their release mechanisms that are coupled together, so that the bindings themselves can be secured on the board in the desired angular arrangement independently from one another. It is then only necessary to couple their release mechanisms together in accordance with the invention in suitable manner, for example via levers, cables, hydraulic lines or the like.

In other words, with an arrangement of the two plate bindings which are completely independent from one another care is taken, in accordance with the invention, solely that the release mechanisms control one another in the manner of the invention.

A particularly advantageous embodiment is characterised in that the release mechanisms of the two plate bindings are acted on by a common actuation and safety release element. Thus, after stepping into the two boot bindings only a single common actuation and safety release element need be actuated in order to simultaneously close both boot bindings. As the two release mechanisms are connected to the actuation and safety release element in parallel both release mechanisms can bring about the release independently from one another, whereby the other release mechanism is then simultaneously also freed. The actuation and safety release element is expediently constructed in the manner which is described in German utility model specification 18 73 952 for a ski binding. This embodiment thus combines in a particularly advantageous manner the requirement for a particular simple construction and mutual influencing of the release behaviour in the sense of the invention. The plate bindings can also be arranged with this embodiment on the board at suitable angles completely independent of one another, with it being ensured solely through levers, cables, hydraulic means or the like that the release mechanisms of the two bindings are acted on by the common actuation and safety release element.

Each board binding preferably has a movable latching element which is acted on by the common actuation and safety release element via a force transmission such as a cable run, a Bowden cable, a lever linkage or a hydraulic line. Moreover, the common actuation and safety release element is preferably a central hand clamping device which is releasable in the presence of excessive tensile forces and arbitrarily by hand.

In such an arrangement each plate binding preferably has a movable spring loaded latching element which during a release of the other respective plate binding is at least partially relieved via at least one force transmitting line, such as a Bowden cable or the like, by a component of the releasing plate binding which moves during the release. The relief is preferably effected in such a way that the release of the other plate binding is substantially simplified. In particular the release of the latching element which occurs during the release of each binding is conveniently exploited for the relief of the latching element of the other respective plate binding. This embodiment ensures that the release force of one of the plate bindings is reduced when the other respective plate binding is released.

In this embodiment the two plate bindings are also mountable on the board at any desired angular position and the force and/or the path changes which occur during release at the associated latching element are exploited in order to achieve the desired loading of the other release mechanism in accordance with the invention via suitable force transmitting means. Since the two plate bindings do not have to support one another by some form of stiff connection member extending in the longitudinal direction of the board no problems arise when the board is moving (sliding), in the sense that the release behaviour is changed or in particular deteriorates, in particular on bending of the snowboard. With this embodiment the concept of the invention also manifests itself in the fact that two plate bindings can be mounted completely independently of one another and that mutual influencing of the release mechanisms simply takes place through control lines. The influencing of the release force of each binding by the other respective plate binding can be effected in particularly expedient manner by a sporting board in which the movement of the release plate which takes place during the release of the binding is exploited for the relief of the latching element of the other plate binding.

An especially important embodiment of the present invention is characterised in that the actuating and safety release element also acts on a board brake having at least one brake arm pivotable outwardly beneath the sliding surface of the board, so that during release of one of the plate bindings the brake arm of the ski brake is also deployed.

An alternative embodiment is characterised in that a board brake is coupled with one of the release plates, or with one of the movable latching elements, in such a way that during a release of the related plate binding the brake arm of the board brake is deployed. In both the last two embodiments the movement of the central actuating and safety release element, or of one release plate, or of one release element, is simultaneously used for the freeing of the board brake.

The common actuation and safety release element is preferably formed by a central board brake arranged between the plate bindings, with the board brake having an energy store which simultaneously acts on the cable and the brake arms of the board brake. In this way the snowboard of the invention can be made more compact and lighter, with the double function of the actuating and safety release element reducing the number of components which are required for the snowboard. A particularly advantageous form of the plate bindings is characterised in that the plate bindings have a base plate insertable into a lower recess of the release plate, with latch projections, of which one is movable, being provided at the front and at the rear on the base plate and cooperating with latch recesses of the release plate.

An alternative advantageous embodiment is characterised in that the base plate has latching elements which are movable towards and away from one another and which are formed in dovetail-like manner at the side, with said latching elements cooperating with a central clamping part of the release plate which is formed in a complementary dovetail-like manner.

Figure 4:
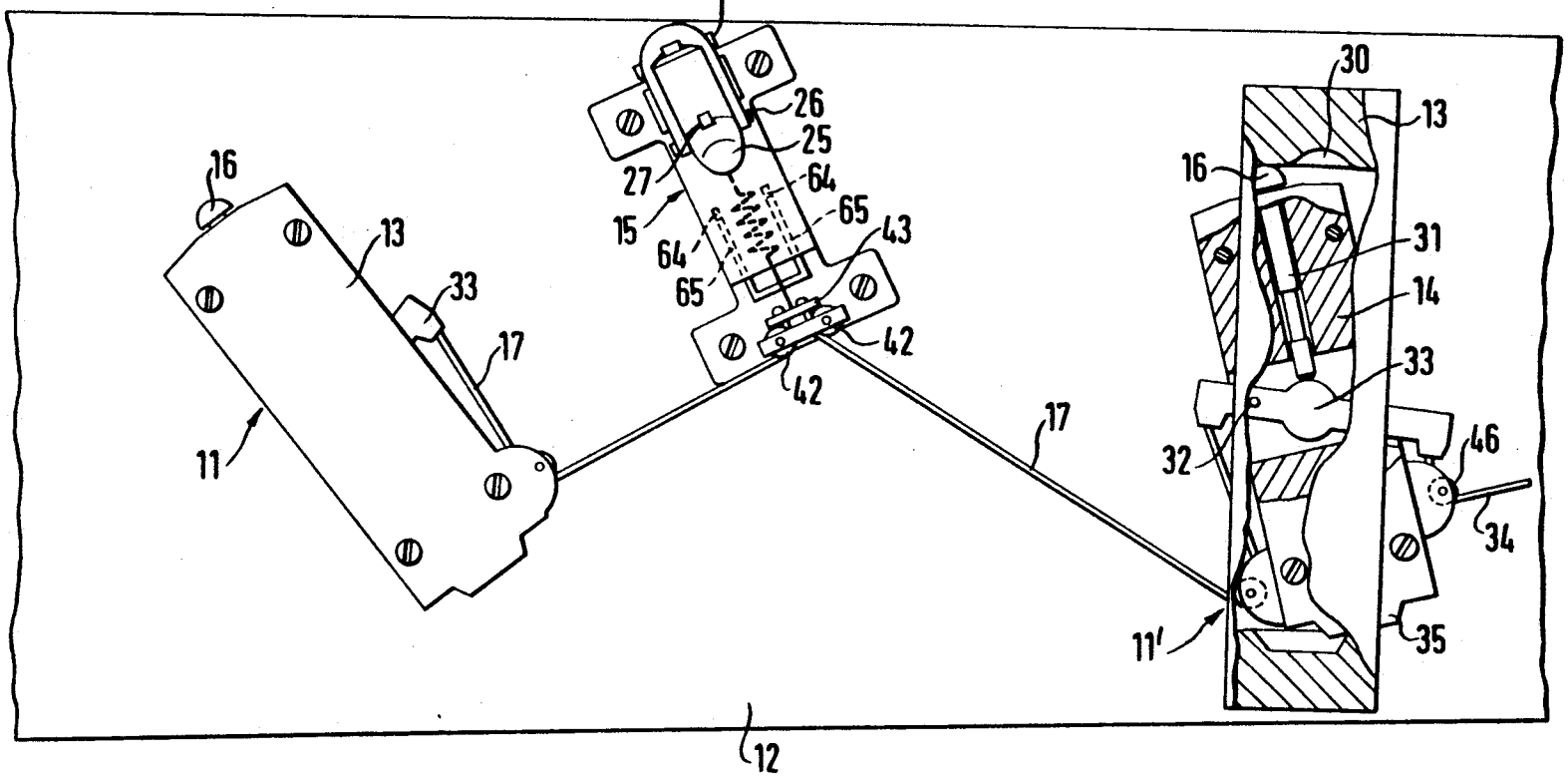
Figure 5:
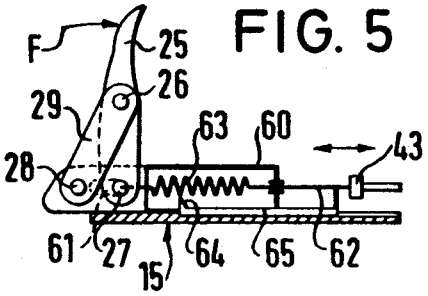
Figure 7A:
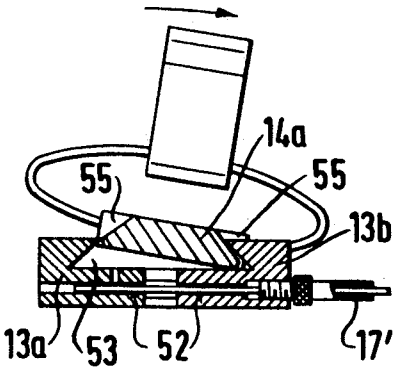
Figure 7:
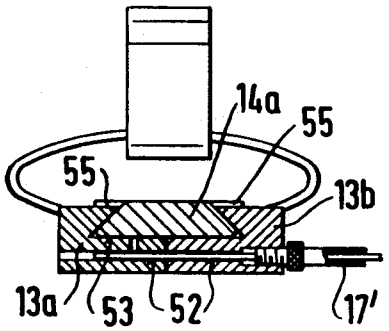
Figure 6:
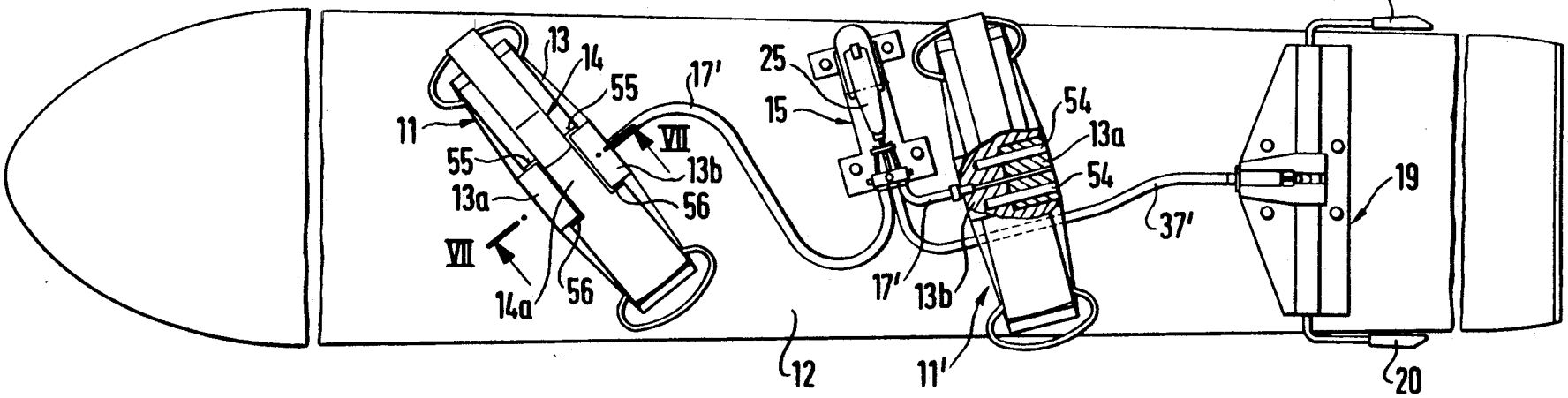
Figure 8:
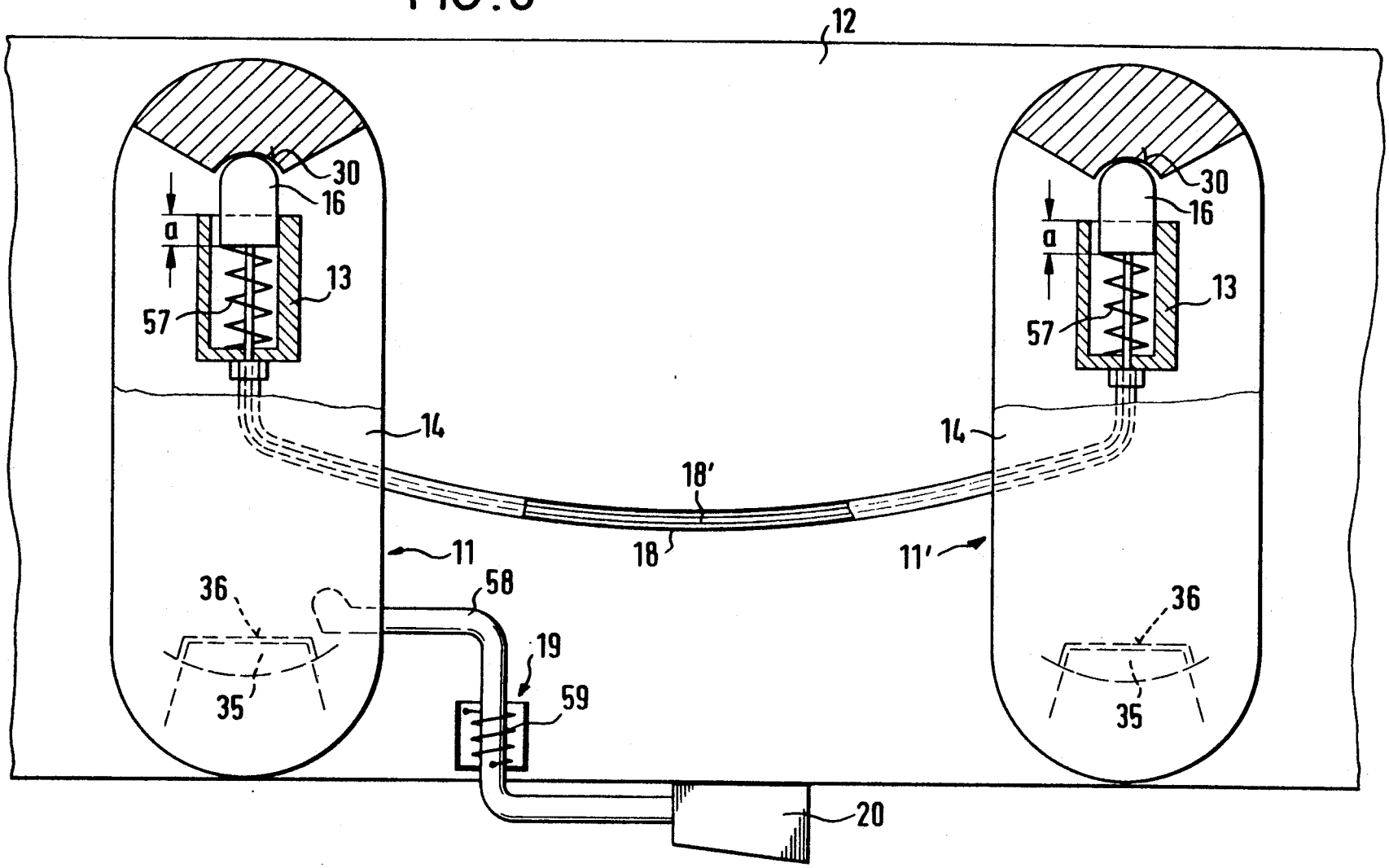
Figure 9:
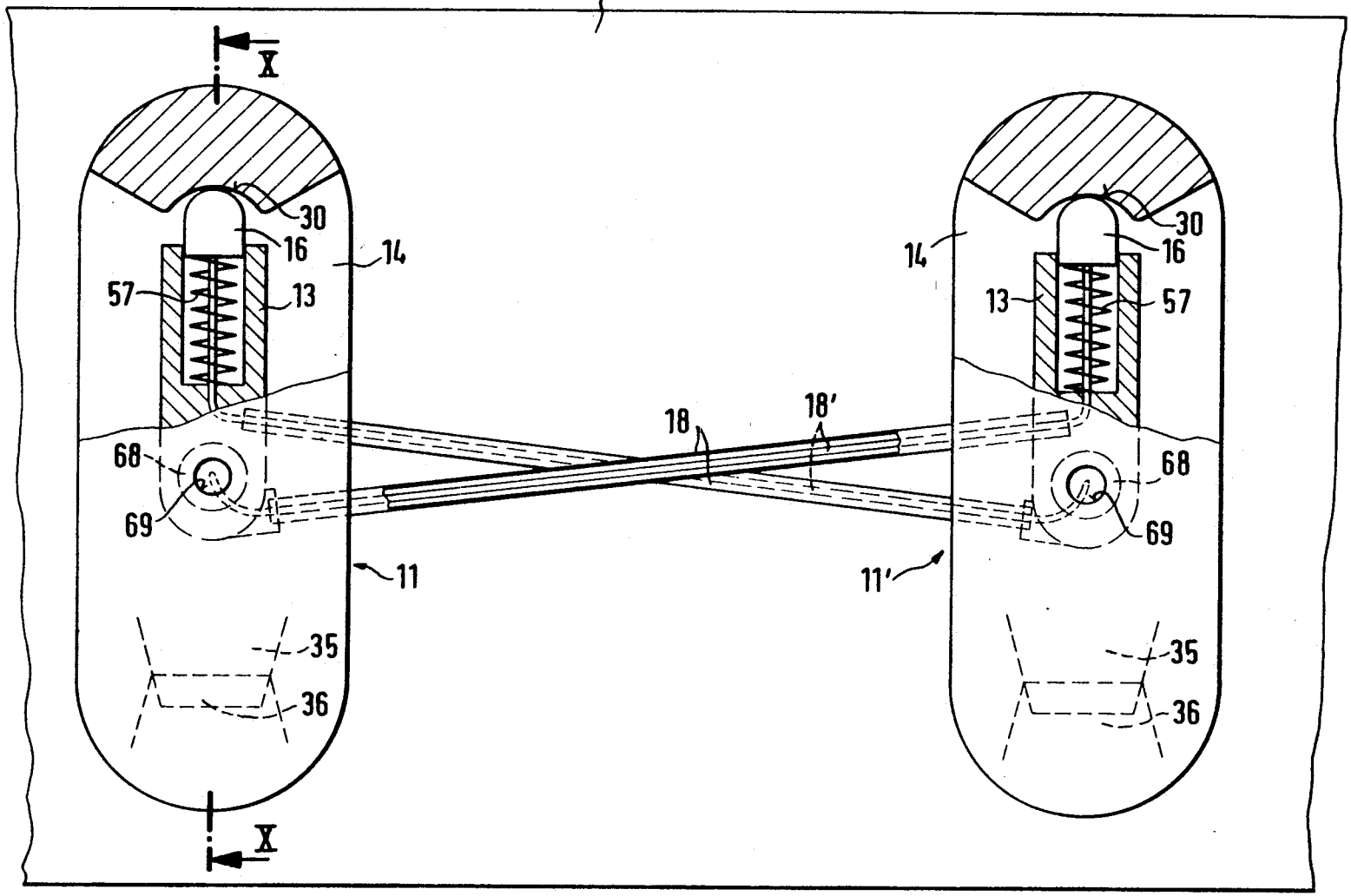
Figure 10:
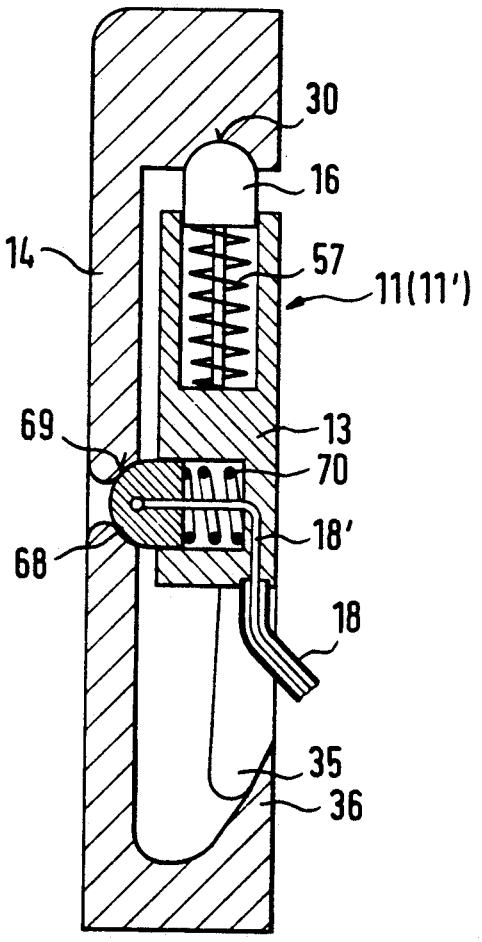

The invention will now be described in the following with reference to the drawing by way of example only, in the drawing there are shown:

FIG. 1 a sideview of a first embodiment of a snowboard in the state ready for use while omitting the boots which are set into the bindings and the boot holding elements of the rear binding, FIG. 1*a* partly sectioned sideview of the ski brake of FIG. 1 in the released braking condition, FIG. 2 a partially sectioned plan view of the subject of FIG. 1, FIG. 3 a sideview of only the plate bindings in accordance with FIGS. 1 and 2 with a ski boot inserted, FIG. 4 a partly sectioned plan view of the snowboard of FIG. 1, but without the board brake, and in the release state, with the left hand release plate being removed and the right hand release plate being reproduced in the just freed state, FIG. 5 a purely schematic sideview of the central actuation and safety release element of FIG. 4 in the open state, FIG. 6 a plan view of a further embodiment of a snowboard in accordance with the invention with closed plate bindings, FIG. 7 a section on the line VII—VII in FIG. 6, FIG. 7*a* the same section with the release plate in the state of a tilting release, FIG. 8 a schematic plan view of a further embodiment, FIG. 9 a schematic plan view of a yet further embodiment, and FIG. 10 a section in the line VIII—VIII in FIG. 9.

In all figures the same reference numerals are used to designate components having the same function.

In accordance with FIGS. 1 to 3 two plate bindings 11, 11' are secured behind one another on a snowboard 12. The front plate binding subtends an angle of approximately 50° with the longitudinal axis 38 of the board 12 and the rear plate binding subtends an angle of approximately 75° with this longitudinal axis. In accordance with FIGS. 1 to 3 each plate binding 11, 11' comprises a base plate 13 which is fixedly screwed to the board and which engages from below into a recess 37 of a release plate 14 arranged above it, with the recess having the shape of an inverse U in sideview. The release plates carry front loops 21 with clamping levers 22 and heel loops 23 by means of which a boot can be firmly mounted on the release plate 14 in accordance with FIG. 3. The release plate 14 can also fundamentally be formed by the boot sole itself, i.e. integrated into the latter.

As can be seen from the broken away illustration of the rear plate binding 11' in FIG. 2 a thrust transmitting element in the form of a pin 31 is slidingly arranged in a central guide channel 39 of the base plate 13, with the guide channel 39 extending in the longitudinal direction of the plate binding. At its front end the pin has a latching element 16 in the form of a hemispherically shaped head which engages into a latch recess 30 of the release plate 14. At the rear end the base plate 13 has a fixed latch projection 35 provided with oblique surfaces which engages into a counter-latch recess 36 of the release plate 14 which is of complementary shape thereto. The latch projections 16, 35 and the latch recesses 30, 36 are so shaped and arranged within one another that, as a result of the resilient loading of the latch element 16 in the direction of the latch recess 30, a safety release of the release plate 14 is ensured relative to the base plate 13 with predetermined torsional forces about a vertical axis and predetermined tilting forces about the longitudinal axis 40' of the plate binding 11, 11'. The latch recesses 30, 36 thus also partly engage over the associated latch projections 16, 35 from above.

The resilient loading of the latch element 16 in the direction of the latch recess will now be explained in more detail with reference also to FIG. 4. The rear end of the pin 31 is loaded by an engagement projection 40 on a transversely extending force deflecting lever 33 which is pivotally journalled on the base plate 13 about a hinge 32 with a vertical axis which is provided to the side of the central axis 40'. A lever arm 33' of the force deflecting lever 33 which is provided on the side of the hinge 32 remote from the projection 40 is acted on by a cable 17 which is guided via a deflection roller 41 fixed relative to the board to a central actuation and safety release element 15 which is secured to the surface of the board 12 between the plate bindings 11, 11'. At the central actuation and safety release element two cables 17 (i.e. one from each binding) are connected together at a yoke 43 via guide rollers 42.

The central actuating and safety release element 15 has at its output a yoke 43 which extends transversely to the direction of the tensile forces and which transmits the actuation and holding forces to two cable runs 17 which are arranged parallel to one another. The second cable 17 leads via the left hand guide roller or pulley 42 to a further deflection roller 44 at the plate binding 11 from where the cable 17 is guided to a force deflecting lever 33 which is formed and loaded in mirror image manner to the force deflecting lever 33 of the plate binding 11'. The internal construction of the plate binding 11 corresponds in other respects to that of the rear plate binding 11'.

The central actuating and safety release element 15 is built up as follows:

As seen in FIGS. 2, 4 and 5 a hand clamping lever 25 is mounted in lateral elongate slots 61 of a binding housing so that it is pivotally mounted and restrictedly displaceable in the pulling direction indicated by the double arrow (FIG. 5). At a distance from the hinge 27, which is displaceable in the elongate slot 21, a toggle lever hinge 26 is arranged on the hand clamping lever 25 from which the toggle lever links 29 extend forwardly to a further hinge 28 which is provided in front of the displaceable hinge 27 at the binding housing 60. A release spring 63 is secured to the displaceable hinge 27 and is connected at the end remote from the hinge 27 to the yoke 43 from which the two cables 17 extend via the deflection pulleys 42 to the plate bindings 11, 11'.

If the hand clamping lever 25 is pivoted downwardly from the open position of FIG. 5 in the direction of the arrow F into its closed position then the toggle lever hinge 26 moves into a somewhat lower position than the two mutually axial aligned hinges 27, 28. This position of the toggle lever hinge 26 corresponds to an over dead center position in which the hand clamping lever 25 is secured against opening by the tensile force of the release spring 63. On pressing the hand clamping lever 25 downwardly the hinge 27 moves forwardly in the elongate slot 61 and thereby tensions the release spring 63 in such a way that the two plate bindings 11, 11' are fixed in their closed positions.

In the closed position of the actuation and safety release device 15 a double wedge abutment 64 illustrated in FIGS. 4 and 5 engages behind the axle of the toggle lever hinge 26. The wedge abutment 64 is attached via elongate sliders 65 to the draw member 62 which connects the release spring 63 to the yoke 43.

If now as a result of excessive torsional or tilting loading at one of the plate bindings 11, 11' an excessive tensile force is exerted via one of the cables 17 on the draw member 62, and thus on the release spring 63, the yoke 43 is displaced somewhat away from the binding housing and thereby moves the wedge abutment with it, via the slider 65, and the wedge abutment comes into engagement with the axle of the toggle lever link 26. Because of its wedge form the wedge abutment moves the toggle lever hinge 26 upwardly beyond its dead center position, whereupon the hand clamping lever 25 automatically snaps into the open position which can be seen in FIG. 5. A safety release is carried out in this manner.

As both plate bindings 11, 11' are connected to the same actuation and safety release device 15 the release of one of the plate bindings 11, 11' signifies that the other plate binding 11', 11 is automatically released with it. A further cable 34 leads from an extension provided at the end of the force deflecting lever 33 remote from the lever arm 33' via a deflection pulley 46 fixed to the board to a board brake 19 arranged behind the plate binding 11'. The board brake 19 has two brake arms 20 which extend laterally beyond the edges of the board 12. The construction and operation of the brake arms can be seen in detail from FIGS. 1 and 1*a*. The brake arms 20 are mounted on a common transverse shaft 47 which is located above the board 12 and which carries at its center a drive element 48 flattened at one side 49. An actuating lever 50 is also arranged on the drive element.

The tension cable 34 acts on the actuating lever 50 at approximately a right angle. The flat side 49 is loaded by the displaceable abutment 51' of a deployment spring 51.

If the cable 34 is tensioned via the rear cable 17 and the force deflecting lever 33 as a result of the closing of the actuation and safety release device 15, the lever 50 is drawn forwardly (FIG. 1) out of the braking position (FIG. 1*a*) whereby the deployment spring 51 is compressed and the brake arms 20 are pivoted into the position evident from FIG. 1 above the surface of the board 12. If the central actuation and safety release device 15 is opened by hand or as a result of a safety release then the cable 34 is loose in accordance with FIG. 1*a* and the deployment spring 51 can pivot the brake arms into the braking position of FIG. 1*a* via the flat side 49.

The board brake 19 can also be arranged between the two plate bindings 11, 11' in place of the central actuation and safety release device 15 and can be provided with an energy store which tensions the two cables 17 leading to the plate bindings 11, 11' in order to keep the plate bindings 11, 11' in their closed position. In this arrangement the energy store of the board brake 19 loads the brake arms of the board brake 19 in such a way that they are kept above the surface of the board 12. As soon as at least one of the plate bindings 11, 11' adopts its open position as a consequence of an excessive torsional or tilting load the brake arms 20 of the board brake 19 are pivoted outwardly into their braking position by the energy store.

The operation of the described snowboard is as follows:

After the release plates 14 of FIGS. 1 to 3 have been secured onto the base plates 13 by closing of the actuation and safety release device 15 the two ski boots 24 can be secured in the manner shown in FIG. 3 to the release plates 14.

When excessive torsional and tilting forces act on the ski boot 24 the actuation and safety release device 15 springs open in the manner shown in FIGS. 4 and 5 and the release plates 14 of the plate bindings 11, 11' are released due to the possibility of forceless pushing back of the latching element 16. In FIG. 4 the left hand release plate 14 with the boot secured thereto has already been completely removed from the base plate 13 so that it is no longer visible, whereas the right hand release plate 14 in FIG. 4 is shown at the stage of the release movement prior to full separation from the base plate 13.

By lifting the hand clamping lever 25 out of the position of FIGS. 1 to 3 both plate bindings 11, 11' can also be arbitrarily opened by hand and can be closed again by depressing the hand clamping lever 25.

In the embodiment of FIGS. 6 to 7a Bowden cables 17' and 34' are provided between the central actuation safety release device and the plate bindings 11, 11' and board brake 19 respectively in place of the cables 17, 34. In this manner one can exert not only tension forces but also pressure forces on the plate bindings 11, 11', and also on the ski brake 19, by the central actuating and safety release device 15. Thus the deployment spring 51 of the ski brake can be omitted.

The Bowden cable 17' operates in the manner evident from FIGS. 7, 7a on two laterally oppositely disposed latching elements 13a, 13b of which the right hand element 13b is firmly secured to the base plate 13, while the left hand element 13a is displaceable sideways in the manner shown in FIG. 7a. The laterally introduced Bowden cable, which is braced against the fixed latching element 13b, acts on the laterally movable latch element 13a through transverse bores 52. The latching elements 13a, 13b generally have an upwardly open recess 53 which tapers in dovetail-like manner upwardly. The complementary dovetail-like central part 14a of the release plate 14 engages into the upwardly open recess 53. Transversely extending guide pins 54 which can be seen in FIG. 6 at the plate binding 11' extend from the fixed latching element 13b within slide bores of the movable latching element 13a and ensure a troublefree lateral guidance of the movable latch element 13a.

In front of and behind the dovetail-like central part 14a of the release plate 14 there are provided axial abutments 55, 56 with which the release plate 14 acts in form-locked manner from the front and rear on the latching elements 13a, 13b.

When the latching elements 13a, 13b are drawn together in accordance with FIGS. 6 and 7, i.e. when the central actuating and safety release device 15 is closed, the latching elements 13a, 13b clamp the release plate 14 at its central part 14a in form-locked manner as can be seen from FIGS. 6 and 7.

If now lateral tilting forces act in the sense of the arrow in FIG. 7a on the ski boot, which is not illustrated in the drawing, then the upwardly converging side surfaces of the dovetail-like central part 14a of the latching elements 13a, 13b exert a separating moment on the latching elements 13a, 13b so that the latter are pressed apart in accordance with FIG. 7a, on reaching a predetermined tilting force. The Bowden cable 17' exerts an opening force onto the central actuation and safety release device 15 which then snaps open in the above described manner, whereby the release plate 14 is freed. Through the snapping up of the central actuation and safety release device 15 the movable latching element 13a of the other plate binding 11' is simultaneously moved into the open position. Moreover the brake arms 20 of the board brake 19 are deployed.

In the embodiment of FIG. 8 both plate bindings 11, 11' are arranged precisely transverse to the longitudinal axis of the board 12. The arrangement could however also be the same as in the preceding embodiment. The latch projections 35 and the counter-latch recesses 36 are arranged in a reverse arrangement relative to the preceding embodiments. This is also straightforwardly possible in the other embodiments in the sense of a kinematic inversion.

The axially movable latching elements 16 which cooperate with the latch recesses 30 of the only schematically illustrated release plates 14 are biased by springs 57 in the direction of the latch recesses 30. Moreover, the movable latch elements 16 of the two plate bindings 11, 11' are connected to one another via a Bowden cable 18. In the closed position of the two plate bindings 11, 11', which can be seen from FIG. 8, the tension member 18' of the Bowden cable 18 has just been tensioned.

If one of the two plate bindings 11 now releases then the corresponding movable latching element 16 is free and can be displaced further forwardly by the amount "a" through the force of the associated spring 57 as a result of the additional movement play "a" provided in accordance with the invention. After the release of, for example, the plate binding 11, the force of the associated spring 57 thus acts via the tension member 18' of the Bowden cable 18 in a relieving sense on the movable latching element 16 of the other plate binding 11' so that its release is correspondingly made easier. Thus a release is achieved at the other plate binding 11' even with small torsional or tilting forces.

In accordance with FIG. 8 the actuating arm 58 of a board brake 19, can also engage beneath the one release plate 14, and indeed in such a way that the brake arm 20 is located above the surface of the board 12. If the associated release plate 14 is freed during a release from the base plate 13 then the actuating arm 58 is also free and for example a coil spring 59 can now deploy the brake arm 20 into the braking position beneath the lower surface of the board 12.

If desired a corresponding board brake 19 can be arranged at the opposite side on the same plate binding 11 or at the other plate binding 11'.

In the embodiment of FIGS. 9 and 10 two Bowden cables 18 with tension members 18' are provided which—in analogy to the embodiment of FIG. 8—are connected in tension with a respective movable latching element but which however act at the other end on a special latching element 68 which is vertically displaceably arranged in a bore of the base plate 13 and which engages from the latter upwardly into a latch recess 69 in the lower side of the release plate 14. A vertically acting compression spring 60 brings the latching member 68 into engagement with the latch recess 69. Each latching member 68 is connected with the tension member 18' of a Bowden cable 18, the opposite end of which is in connection with the movable latching element 16 of the other respective plate binding.

When the plate bindings 11, 11' are closed the force of the springs 70 is born by the release plate 14 via the latching element 68 and the latching recess 69. If however the release plate 14 is separated from the base plate 13 after a release then the force exerted by the spring 70 on the latch member 68 is transmitted via the associated Bowden cable 18 to the movable latching element 16 of the other plate binding 11, 11' respectively, so that this latching element 16 is correspondingly relieved, and the release of the relevant plate binding 11 or 11' respectively is correspondingly mad easier.

We claim:

1. Sporting board comprising: a board member having a longitudinal direction and two boot bindings for securing a skier's boots to the board member, each boot binding having a respective longitudinal axis arranged at a considerable angle to said longitudinal direction of said board member, each said boot binding comprising an associated base plate secured to the board and a release plate associated with a respective one of said skier's boots, said base plates being longitudinally spaced along said board member, each said release plate being arranged above the associated base plate in alignment therewith, a latching mechanism located between each said release plate and the associated base plate to secure each said release plate to the associated base plate and to release each said release plate from the associated base plate when a predetermined torsional load is exerted on said release plate relative to the associated base plate and when a predetermined tilting load is exerted on said release plate relative to said base plate, a common actuation and safety release mechanism for both said latch mechanisms, respective coupling means for coupling each said latch mechanism to said common actuation and safety release mechanism, said common actuation and safety release mechanism being releasable by hand and releasable in response to an excessive force applied to it by either of said latch mechanisms via the respectively associated coupling means, wherein said common actuation and safety release mechanism comprises a single spring means, and said coupling means are connected in force-sharing manner to said spring means, whereby release of said common actuation and safety release mechanism results in the simultaneous release of said release plates from the associated base plates.

2. Sporting board in accordance with claim 1, further comprising releasable means for releasably connecting each said release plate to an associated one of said skier's boots.

3. Sporting board in accordance with claim 1, further comprising each said release plate being formed by a sole of a respective one of said skier's boots.

4. Sporting board in accordance with claim 1, wherein said common actuation and safety release mechanism comprises a hand-actuated lever pivotable between a clamping position and a release position, and means for pivoting said lever to the release position on release of said common actuation and safety release mechanism.

5. Sporting board comprising: a board member having a longitudinal direction and two boot bindings for securing a skier's boots to the board member, each boot binding having a respective longitudinal axis arranged at a considerable angle to said longitudinal direction of said board member, each said boot binding comprising an associated base plate secured to the board and a release plate associated with a respective one of said skier's boots, said base plates being longitudinally spaced along said board member, each said release plate being arranged above the associated base plate in alignment therewith, a latching mechanism located between each said release plate and the associated base plate to secure each said release plate to the associated base plate and to release each said release plate from the associated base plate when a predetermined torsional load is exerted on said release plate relative to the associated base plate and when a predetermined tilting load is exerted on said release plate relative to said base plate, a common actuation and safety release mechanism for both said latch mechanisms, respective coupling means for coupling each said latch mechanism to said common actuation and safety release mechanism, wherein said common actuation and safety release mechanism comprises a single spring means, and said coupling means are connected in force-sharing manner to said spring means, whereby release of said common actuation and safety release mechanism results in the simultaneous release of said release plates from the associated base plates.

6. Sporting board in accordance with claim 5, further comprising: releasable means for releasably connecting each said release plate to an associated one of said skier's boots.

7. Sporting board in accordance with claim 5, further comprising: each said release plate being formed by a sole of a respective one of said skier's boots.

8. Sporting board in accordance with claim 5, further comprising: a board brake coupled to the latching mechanism of a given plate binding in such a way that during a release of the given plate binding a brake arm of the board brake is deployed.

9. Sporting board in accordance with claim 5, further comprising: each plate binding having a movable latching element which is acted on by the common actuation and safety release element via a force transmission member.

10. Sporting board in accordance with claim 5, further comprising: the common actuating and safety release device acts on a board brake having at least one brake arm pivotable outwardly beneath a sliding surface of the board in such a way that during a release of one of the plate bindings the brake arm of the ski brake is also deployed.

11. Sporting board in accordance with claim 5, further comprising: a board brake coupled to the release plate of a given plate binding, in such a way that during a release of the given plate binding a brake arm of the board brake is deployed.

12. Sporting board in accordance with claim 5, further comprising: the common actuation and safety release mechanism being formed by a central board brake arranged between the plate bindings, with the board brake having an energy store which simultaneously acts on a cable and brake arms of the board brake.

13. Sporting board in accordance with claim 5, further comprising: the plate bindings having a base plate insertable into a lower recess of the release plate, at least two latch projections, of which one latch projection is movable, being provided at a front and at a rear on the base plate and cooperating with latch recesses of the release plate.

14. Sporting board in accordance with claim 5, further comprising: the plate bindings having a base plate insertable into a lower recess of the release plate; and the base plate having latching elements which are movable towards and away from one another and which are formed in dovetail-like manner at the side, with said latching elements cooperating with a central clamping part of the release plate, which is formed in a complementary dovetail-like manner.

* * * * *